United States Patent [19]

Newcomer

[11] Patent Number: 4,653,747

[45] Date of Patent: Mar. 31, 1987

[54] SIT-UP EXERCISE APPARATUS

[75] Inventor: Paul A. Newcomer, Westlake Village, Calif.

[73] Assignee: Paul A. Newcomer, Inc., Sherman Oaks, Calif.

[21] Appl. No.: 749,811

[22] Filed: Jun. 28, 1985

[51] Int. Cl.[4] ..... A63B 23/02

[52] U.S. Cl. ..... 272/93; 272/900

[58] Field of Search ..... 272/93, 900, 145, 146; 248/231.2, 231.5, 231.8; 292/76, DIG. 19; D8/402

[56] References Cited

U.S. PATENT DOCUMENTS

| | | | |
|---|---|---|---|
| D 33,424 | 10/1900 | Ballard | D 8/402 |
| D 52,825 | 12/1918 | Leach | D 8/402 |
| 914,179 | 3/1909 | Patterson | 292/DIG. 19 X |
| 1,040,887 | 10/1912 | Coffman | 292/DIG. 19 X |
| 1,953,857 | 4/1934 | Hunter | 272/145 |
| 2,042,249 | 5/1936 | Constantine | 273/80 D |
| 2,050,652 | 8/1936 | Fleming | 272/93 |
| 2,425,971 | 8/1947 | Walker | 272/900 |
| 3,134,592 | 5/1964 | Sharkey | 128/84 R |
| 3,850,430 | 11/1974 | Hamilton | 272/143 |
| 4,116,434 | 9/1978 | Bernstein | 272/900 |
| 4,134,608 | 1/1979 | Pool | D 8/402 X |
| 4,185,816 | 1/1980 | Bernstein | 272/900 |
| 4,186,903 | 2/1980 | Fazakerley | 248/231.8 |
| 4,230,313 | 10/1980 | Chupp, Jr. | 272/93 |
| 4,245,839 | 1/1981 | Trent | 272/900 X |
| 4,468,022 | 8/1984 | Wu | 272/93 |

FOREIGN PATENT DOCUMENTS

| | | | |
|---|---|---|---|
| 393160 | 10/1965 | Switzerland | 272/93 |
| 680,556 | 8/1901 | United Kingdom | 272/900 |

*Primary Examiner*—Richard J. Apley
*Assistant Examiner*—S. R. Crow
*Attorney, Agent, or Firm*—Christensen, O'Connor, Johnson & Kindness

[57] ABSTRACT

A sit-up device apparatus adapted to be utilized in conjunction with a door having spaced apart vertically extending surfaces and a bottom intermediate the surfaces. The apparatus is comprised of a frame configured as to be removably secured under the door. The frame includes an elongated base with surfaces oppositely disposed in a fashion as to create a certain compression of the frame when device is extended below the bottom of the door and upon the surface of the floor. The upper surface of the elongated base is configured in such a fashion as to engage the bottom surface of the door, and in combination with a section of material affixed to the upper surface of the elongated base, whose front surface is positioned as to engage the lower portion of the backside wall of the door, the device is aligned and secured in its operative position. The portion of the frame remaining on the users side of the door is adapted to extend upward to connect with a bar, causing the bar to be parallel to the floor, and elevating the bar to a height so as to be readily engaged by the feet of the user of the sit-up device. A coupling assembly is provided for releasably securing the bar to the frame.

6 Claims, 6 Drawing Figures

6
1
15
7
9
4
3
2
14
118
10
5
11
13
12

SIT-UP EXERCISE APPARATUS

BACKGROUND OF THE INVENTION

1. Field Of The Invention

The present invention relates to a sit-up exercise apparatus to primarily facilitate the exercising of the abdominal muscles by male and female users thereof.

The need for exercise has become amply documented, and a device to assist individuals in performing exercise at home is a most important implement in a exercise program. The ability to perform sit-ups is an important part of most individuals physical conditioning programs.

2. Description Of The Prior Art

The prior art has appreciated the need to restrain the feet when performing a sit-up exercise. As disclosed in U.S. Pat. No. 1,953,857 to Hunter, there is provided a device which is positioned on the floor and requires the user thereof to have his or her body extend thereacross. This provides a problem of storage, as well as the need to purchase a support panel which is not necessary for performing the sit-up exercise.

An ideal solution to a sit-up exercise apparatus would be a device that is readily transportable, and one such device is disclosed in U.S. Pat. No. 2,050,562 to Fleming. Fleming utilizes a complicated structure for securement of the floor exercise device between the underside of the door and the floor.

In more recent years, certain design improvements have been made in devices, which when attached to a door, aid the individual in performing the sit-up exercise. Two such devices are disclosed in U.S. Pat. No. 4,116,434 and U.S. Pat. No. 4,185,816, both to Bernstein. The Bernstein devices require the user to partially open the door, slide a portion of the apparatus in from the end of the door, manually engage a clamping device on the backside of the door and then return to the front of the door and bring the door to its closed position. A problem exists for the user of these devices as, quite commonly, a doorstop exists on the backside of the door at such a location as to prevent the installation entirely.

I have discovered that it is possible to provide a sit-up exercise apparatus that is readily secured to a door, from a position in front of the door, and without the means of a manually operated clamping device. The user is also able to remove my invention from the door with a minimum of effort. A very small area of my device comes in contact with the readily visable surfaces of the door, thus minimizing possible marring of the door surface during installation or use. Further, the use of my invention is not inhibited by the existence of a doorstop.

OBJECTS OF THE INVENTION

An object of my invention is to provide a device for facilitating exercising of the abdominal muscles, by comfortably and securely holding an individuals feet during the execution of the sit-up exercise.

Another object of my invention is to provide a sit-up exercise device that readily engages and secures itself to a door without a manually operated clamping device.

Another object of my invention is to provide a sit-up exercise device that may be used in conjunction with a door, without it being necessary for the user to first remove an existing doorstop.

Another object of my invention is to provide a sit-up exercise device that is lightweight and can be easily disassembled for storage or travel.

Other objects and advantages of my invention will become apparent as the disclosure proceeds.

SUMMARY OF THE INVENTION

A sit-up exercise device to be used in conjunction with a door having spaced apart vertically extending surfaces and a bottom intermediate the surfaces. The device is comprised of a frame that is configured in such a manner as to allow a portion of it to be compressed, in a spring-like fashion, and then extended under a door. A piece of material configured in such a manner as to engage the lower edge of the door, opposite the user, is affixed to the the portion of the frame which is passed under the door. When the user relieves the compressive force, the frame and those parts attached thereto engage the door. The portion of the frame remaining on the users side of the door rises at an angle to the floor and away from the vertical face of the door. This portion is connected to a bar, which is held in a position parallel to the floor and at a height as to allow the user to place his or her feet under the bar and allowing it to engage his or her insteps.

Upon completion of the sit-up exercise session, the user may quickly disengage the device from the door by again compressing the appropriate portion of the frame, thus allowing the portion extending under the door to be withdrawn.

The footbar and frame are attached to one another by inserting the appropriate end of the frame into a slot in the bar. These two members are held in this position by a fastener which is passed through a hole in the bar and frame.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
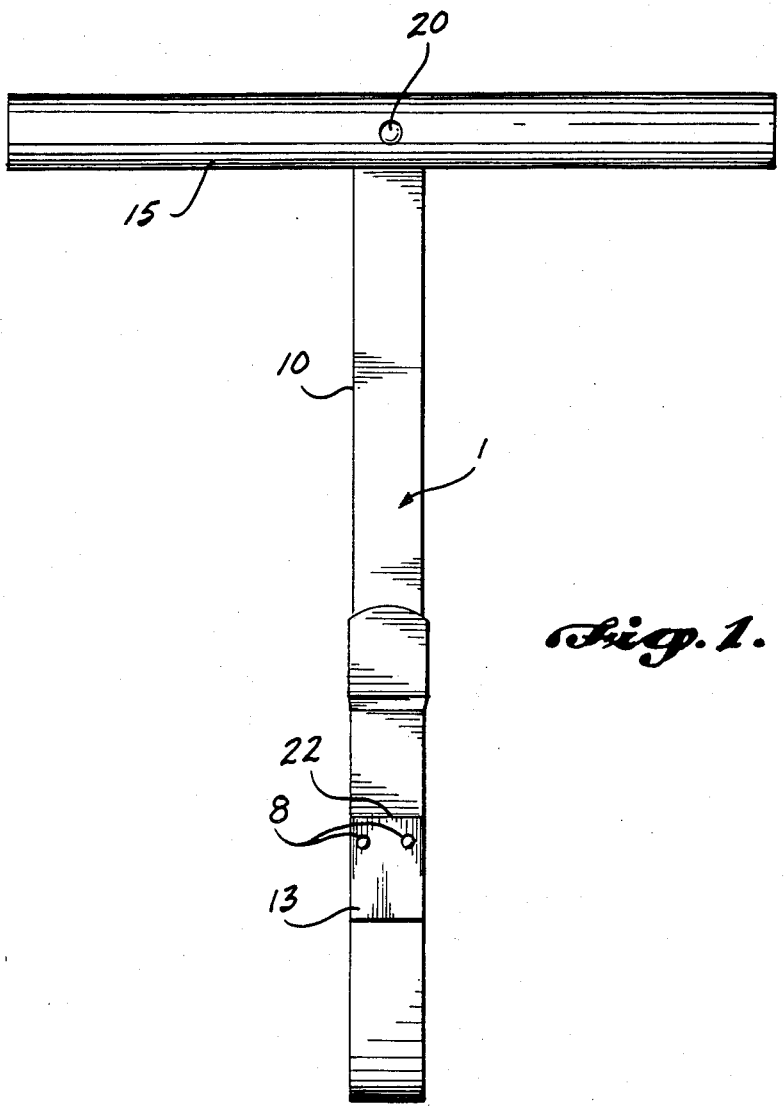
FIG. 1 is a top plan view of the sit-up exercise apparatus in accordance with the present invention.

Referring to the drawings, there is illustrated in FIGS. 1–6 one embodiment of a sit-up exercise apparatus 1 adapted to be utilized in conjunction with a door 2 having spaced apart vertically extending surfaces 3 and 4 and a bottom surface 5 intermediate the surfaces 3 and 4.

The apparatus 1 comprises frame means 10 having oppositely disposed members 11 and 12, member 11 connected to member 12 at one end 11A of said frame means, and extending substantially parallel to member 12, said frame means 10 adapted to be removably secured under the door 2.

As shown in FIGS. 3 through 6, the lower portion of the frame means 10 comprises a base member 11 and an upper member 12 extending in a plane substantially parallel to the bottom surface 5 of the door 2. The base member 11 and the upper member 12 are adapted to extend below the bottom 5 of the door 2. The upper frame member 12 is formed to have a forward abutment surface 12A and rearward abutment surface 12B which define between them an upwardly open depression 12C for receiving the bottom surface 5 of the door 2. The frame means 10 is produced having generally rigid construction, but said frame means may be compressed downward by the user by manual depression of upper member 12 towards lower member 11 of said frame means so as to permit the apparatus to be placed in its operative position between the bottom surface 5 of the door 2 and the floor 9. When the frame means 10 is compressed by the user, the space between the upper member 12 and the base member 11 of the frame 10 is less than the distance between the bottom of the door 5 and the floor 9. When the apparatus is placed in operative position under a door 2, and the compressive force is removed, the lower member 11 and the upper frame member 10 separate from one another defining and conforming to the space between the door 2 and the floor 9, as a result of spring-like tension existing between these frame members due to the resilient properties of the material from which the frame means is fabricated, and the relationship of the frame members to each other. When the user releases pressure from the upper member 12 of the frame 10, the engaging means 13 will be allowed to rise into position, removably securing the apparatus 1 to the bottom surface 5 of the door 2, by placing the surface 22 in contact with the vertical surface of the door 3.

Figure 6:
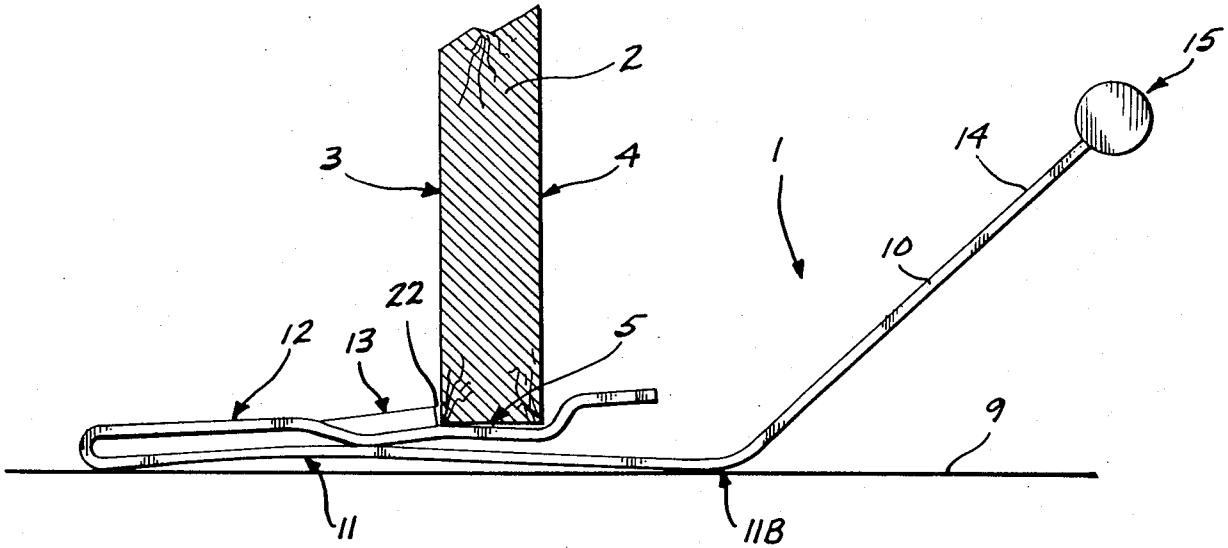
FIG. 6 is a side elevational view, partially in section, illustrating the sit-up exercise apparatus with its frame in the compressed position and engaging the bottom intermediate section of a door.

In FIG. 6, the elongated base member 11 of the frame means 10 comprises a free end portion 14 extending both outwardly and upwardly at an angle from the base member 11 of the frame means 10 at a bend 11B formed in the base member to such a point where the free end portion 14 engages and suspends the footbar 15 at a height from the floor 9 and at a distance outwardly from the vertically extending surface of the door 4 as to allow the user 6 of the apparatus 1 to engage his or her feet 7 in proper position for utilizing the apparatus 1, as hereinafter explained.

Figure 5:
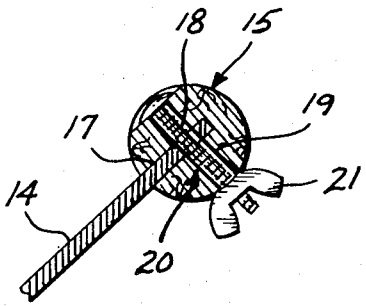
FIG. 5 is an enlarged fragmentary view, in section, illustrating, in detail, the supporting means of the frame removably secured to the footbar by means of a fastener.
Figure 4:
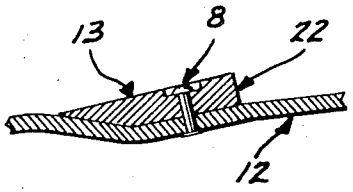
FIG. 4 is an enlarged fragmentary view, in section, illustrating, in detail, the engaging means affixed to the frame of the apparatus, in accordance with the present invention.

Referring to FIG. 5, the footbar 15 is attached to the free end portion 14 by inserting the free end portion 14 into the slot 17 provided in the center of the footbar 15. When the end portion 14 of the elongated base member 11 is thus inserted, a hole 18 in the free end portion 14 of the elongated base member is aligned with a hole 19, extending perpendicularly through footbar 15 to intersect slot 17. A threaded fastener 20, for example, a carriage bolt, is inserted into the entrance end of the hole 19, passing through hole 18 with a portion extending past the exit end of hole 19. Tightening means 21, such as, for example, a wing-nut is affixed to the portion of the carriage bolt 20 extending past the exit end of hole 19.

In the illustrated embodiment, the sit-up apparatus 1 includes engaging means 13 permanently secured to the upper member 12 with fasteners 8. The upper member 12 of the frame means 10 is configured as to allow the top surface of the engaging means 13 to be in substantially the same plane as the top surface of the upper member 12 of the frame means 10. The engaging means 13 may be fabricated from a semi-hard to hard material, having a forward contacting edge 22 so as to provide a surface for engagement with the vertical surface 3 of the door 2.

Figure 2:
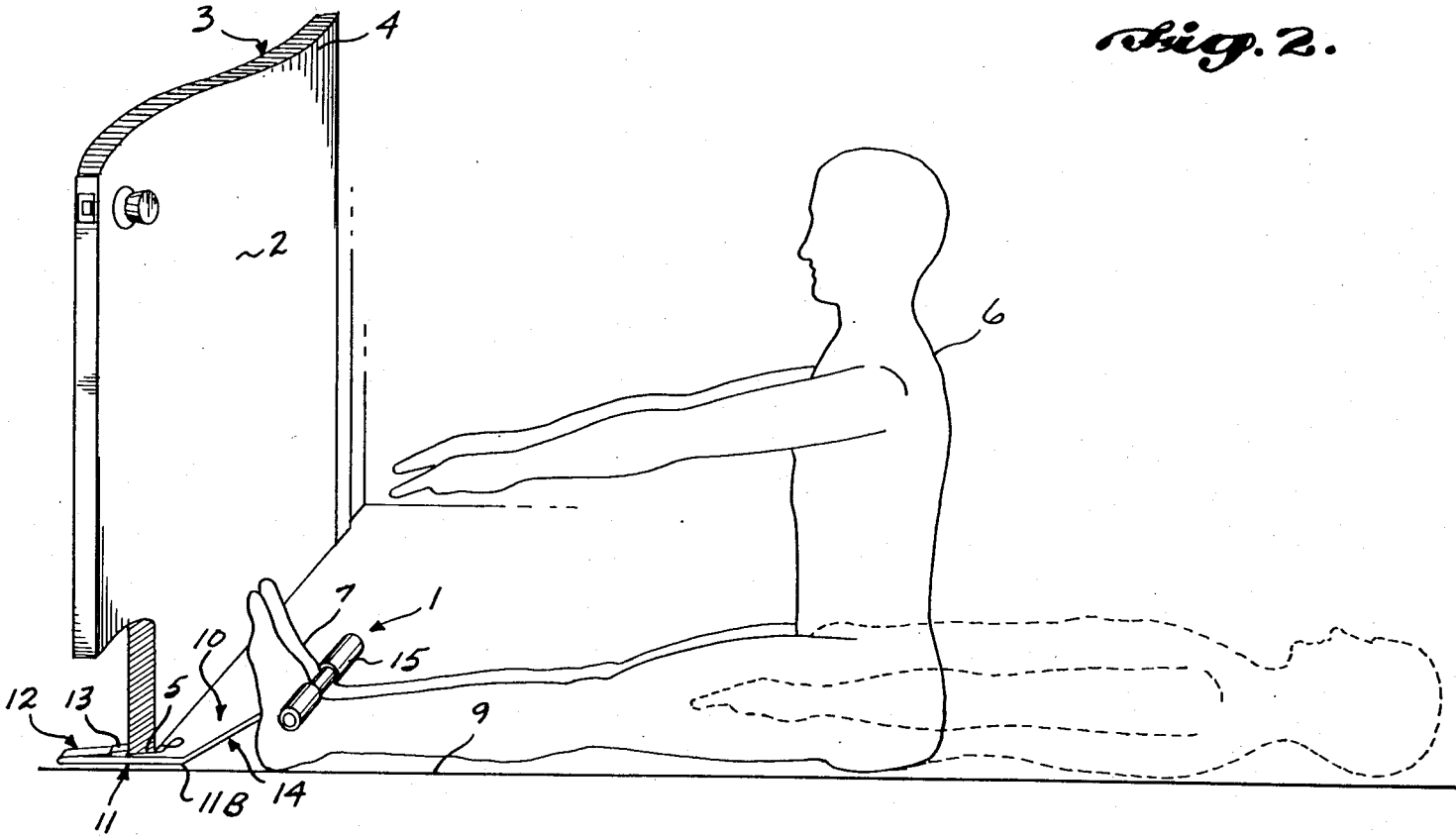
FIG. 2 is a perspective view, partially in section, illustrating the sit-up apparatus, in accordance with the present invention, in its operative position under a door, or the like, and in use by a user performing the sit-up exercise.
Figure 3:
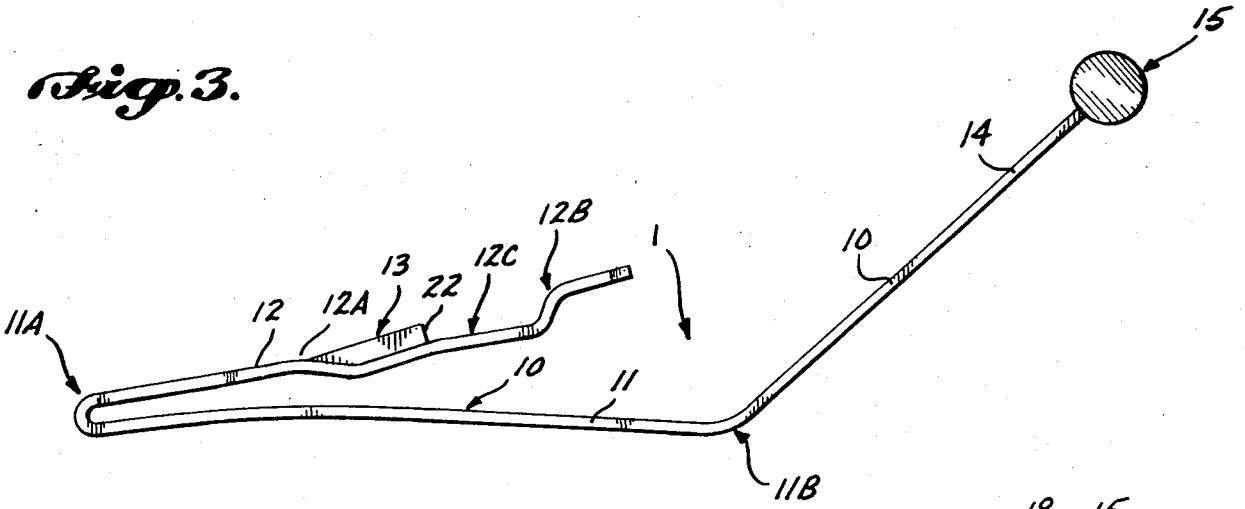
FIG. 3 is a side elevational view, partially in section, illustrating the sit-up exercise apparatus with its frame in the non-compressed position.

Accordingly, the frame means 10, as defined above is readily placed in the operative position illustrated in FIGS. 2 and 6 by compressing the upper member 12 of the frame means 10 in a downward direction towards the base member 11 of the frame means 10, and then passing the compressed frame means 10 under the bottom surface 5 of the door 2, until engaging means 13 may be raised, by relieving the compressive force, into its upmost position, thus allowing its contacting edge 22 to come in contact with surface 3 of the door 2. Door 2 should be in its closed position for use in conjunction with the sit-up apparatus 1.

As shown in FIG. 2, the user places his or her feet 7 under the foot bar 15 to perform sit-ups. When the user's feet engage the footbar 15 a downward pressure is placed on the foot bar and free end portion 14 of the apparatus, which pressure is transmitted through the frame means 10 into the bend 11B in the base member 11. The pressure placed on the bend 11B causes the frame means to flex, pressing the upper frame member 12 against the bottom surface 5 of the door which is received, as is described above, in the depression 12C formed in the upper frame member. In this manner, the sit-up apparatus of the present invention is further secured in place under a door during use by the upward force acting against the bottom surface of the door.

Although illustrative embodiments of the invention have been described in detail herein with reference to the accompanying drawings, it is to be understood that the invention is not limited to the precise embodiments, and that various changes and modifications may be effected therein without departing from the scope or spirit of the invention.

I claim:

1. A sit-up exercise apparatus to be utilized in conjunction with a door having spaced-apart vertically extending surfaces and a bottom intermediate said surfaces, said apparatus comprising:

(a) frame means comprising:

(1) an elongated base frame member having a free end portion proximal to the user, said free end portion rising upwardly from a bend in said base frame member at an angle relative to the horizontal disposition of said base frame member;

(2) an upper frame member integral with and compressibly overlying said elongated base frame member at the end of said base frame member opposite said free end portion, so as to be substantially parallel to and nominally spaced above the base member and configured to form forward and rearward abutment surfaces, said abutment surfaces defining between them an upwardly open depression for receiving the bottom surface of a door and said forward abutment surface retaining the door within said depression;

(b) removable supporting means extending transversely from the free end portion of said elongated base frame member of said frame means, said supporting means adapted to be readily and reversibly engageable by the feet of the user of the apparatus; and (c) coupling means for detachably securing said removable supporting means to said elongated base member so that said supporting means may be easily detached from said frame means for transport or storage by the user of the apparatus, whereby when the feet of the user engage the removable supporting means a downward force is placed on the free end portion of said base frame member and on the bend in said base frame member, so as to flex the apparatus about the bend thereby pressing the upper frame member against the bottom surface of the door to assist in retaining the apparatus in engagement with the door during use.

2. The apparatus according to claim 1 wherein said forward abutment surface of said upper frame member further comprises an engaging means connected to and extending upward from said depression for receiving the bottom surface of a door, said engaging means comprising a semi-hard or hard material positioned so as to present an abutment surface to removably contact the vertical surface of the door opposite the vertical surface facing the user of the apparatus, when said apparatus is placed in operative position under a door.

3. The sit-up exercise apparatus according to claim 1 wherein said coupling means comprises:

(a) a slot within said supporting means into which said upwardly angled free end portion of the elongated base member of the frame means is inserted, said free end portion containing a hole;

(b) a cross hole in said supporting means, intersecting said slot;

(c) fastening means receivable within said cross hole in the supporting means and the hole in said free end portion of the base member to extend through and beyond said cross hole in said supporting means; and (d) tightening means affixed to the portion of said fastening means which extends beyond said cross hole in said supporting means, to detachably couple said supporting means to said frame means.

4. The apparatus according to claim 1 wherein said frame means is configured from a continuous length of reversibly compressible material folded over on itself at the end of said base frame member opposite said free end portion of the base frame member.

5. The apparatus of claim 1 wherein said forward abutment means is integrally formed with said upper frame member.

6. A sit-up exercise apparatus to be utilized in conjunction with a door having spaced-apart vertically extending surfaces and a bottom intermediate said surfaces, said apparatus comprising:

(a) frame means comprising:

(1) an elongated base frame member having a free end portion proximal to the user, said free end portion rising upwardly from a bend in said base frame member at an angle relative to the horizontal disposition of said base frame member;

(2) an upper frame member integral with and compressibly overlying said elongated base frame member at the end of said base frame member opposite said free end portion so as to be substantially parallel to and nominally spaced above the base member and configured to form forward and rearward abutment surfaces, said abutment surfaces defining between them an upwardly open depression for receiving the bottom surface of a door, and said forward abutment surface retaining the door within said depression, and said forward abutment surface further comprising an engaging means connected to and extending upward from said forward abutment surface and said depression for receiving the bottom surface of a door, said engaging means positioned so as to present an abutment surface to removably contact the vertical surface of the door opposite the vertical surface facing the user of the apparatus when said apparatus is placed in operative position under a door, and said forward abutment surface retaining said door in said depression;

(b) removable supporting means extending transversely outwardly from the free end portion of said elongated base frame member of said frame means, said supporting means adapted to be readily engageable and disengageable by the feet of the user of the apparatus; and (c) coupling means for detachably securing said removable supporting means to said elongated base member so that said supporting means may be easily detached from said frame means for transport or storage by the user of the apparatus, whereby when the feet of the user engage the detachable supporting means a downward force is placed on the free end portion of said base frame member and on the bend in said base member, so as to flex the apparatus about the bend thereby pressing the upper frame member against the bottom surface of the door to assist in retaining the apparatus in engagement with the door during use.

* * * * *